US006186500B1

(12) United States Patent
Eugster

(10) Patent No.: US 6,186,500 B1
(45) Date of Patent: Feb. 13, 2001

(54) APPARATUS FOR FEEDING PRINTED PRODUCTS TO A PROCESSING UNIT

(75) Inventor: Albert Eugster, Strengelbach (CH)

(73) Assignee: Grapha-Holding AG, Hergiswil (CH)

( * ) Notice: Under 35 U.S.C. 154(b), the term of this patent shall be extended for 0 days.

(21) Appl. No.: 09/247,607

(22) Filed: Feb. 10, 1999

(30) Foreign Application Priority Data

Feb. 18, 1998 (EP) ..... 98810134.1-125

(51) Int. Cl.[7] ..... B65H 5/02; B65H 29/06; B65H 29/04

(52) U.S. Cl. ..... 271/277; 271/82; 271/204; 271/11

(58) Field of Search ..... 271/11, 82, 204, 271/277, 100, 106, 314; 198/803.1, 803.7, 803.9

(56) References Cited

U.S. PATENT DOCUMENTS

| | | | | |
|---|---|---|---|---|
| 2,508,608 | * | 5/1950 | Huck | 271/277 |
| 2,853,297 | * | 9/1958 | Faeber | 271/11 |
| 3,497,208 | * | 2/1970 | Reinartz et al. | 271/82 |
| 3,992,993 | * | 11/1976 | Kuhn et al. | 271/82 |
| 4,323,029 | * | 4/1982 | Knuppertz et al. | 118/231 |
| 5,064,187 | * | 11/1991 | Muller | 271/204 |
| 5,465,952 | * | 11/1995 | Eberle et al. | 271/204 |
| 5,542,656 | * | 8/1996 | Stauber | 271/11 |
| 5,653,432 | * | 8/1997 | Hansch | 271/82 |
| 6,003,854 | * | 12/1999 | Keller | 271/3.01 |
| 6,039,317 | * | 3/2000 | Kramer | 271/204 |

FOREIGN PATENT DOCUMENTS

| | | | | |
|---|---|---|---|---|
| 408065 | | 9/1966 | (CH) . | |
| 641112 | | 2/1984 | (CH) . | |
| 1122963 | * | 2/1962 | (DE) | 271/204 |
| 1212562 | * | 1/1965 | (DE) | 271/310 |
| 344506 | * | 12/1989 | (EP) | 271/204 |
| 557680 | * | 9/1993 | (EP) | 271/204 |
| 606550 | * | 7/1994 | (EP) | 271/82 |
| 0628505 | | 12/1994 | (EP) . | |
| 2050312 | * | 1/1981 | (GB) | 271/82 |
| 1395527 | * | 5/1988 | (SU) | 271/82 |

* cited by examiner

*Primary Examiner*—Donald P. Walsh
*Assistant Examiner*—Daniel K Schlak
(74) *Attorney, Agent, or Firm*—Friedrich Kueffner

(57) ABSTRACT

An apparatus for feeding printed products to a processing unit includes a rotating conveyor drum which individually pulls the stacked printed products from a magazine; the conveyor drum has on an approximately circular travel path a gripping device formed by at least one movable gripping arm for receiving the printed product from the separating device, wherein the gripping device can be controlled into an open position or closed position by means of a cam mechanism connected to a closed guide track arranged in a vertical plane relative to the axis of rotation and stationary relative to the axis of rotation. The movable gripping arm of the gripping device is connected to a double roller lever which is mounted on the conveyor drum so as to be pivotable about an axis extending parallel to the axis of rotation of the conveyor drum and which travels in two closed guide tracks arranged stationary in at least one vertical plane about the axis of rotation of the conveyor drum.

17 Claims, 1 Drawing Sheet

APPARATUS FOR FEEDING PRINTED PRODUCTS TO A PROCESSING UNIT

BACKGROUND OF THE INVENTION

1. Field of the Invention

The present invention relates to an apparatus for feeding printed products to a processing unit. The apparatus includes a rotating conveyor drum which individually pulls the stacked printed products from a magazine; the conveyor drum has on an approximately circular travel path, against which the printed product partially lifted from the stack by means of a separating device can be placed with an edge to be grasped, a gripping device formed by at least one movable gripping arm for receiving the printed product from the separating device, wherein the gripping device can be controlled into an open position or closed position by means of a cam mechanism connected to a closed guide track arranged in a vertical plane relative to the axis of rotation and stationary relative to the axis of rotation.

2. Description of the Related Art

CH-A-408 065 disclosed a so-called feeding machine of the type described above for a saddle stitcher in which two auxiliary gripping drums for opening the printed products are arranged downstream of the conveyor drum. The conveyor drum is formed by two drum disks which are spaced apart from each other at the axis of rotation, wherein a stationary control cam disk is arranged between the two drum disks. A gripping lever mounted between the drum disk on a shaft arranged eccentrically relative to the axis of rotation of the conveyor drum has at the outer end thereof a gripping member which interacts with the circumference of the drum disk, while at the inner end of the gripping lever is arranged a sensor roller which rests against the control cam disk under the influence of a tension spring connected to the gripping lever. A suction member is pivotably mounted parallel to the axis of rotation of the conveyor drum at the front edge of the stack of printed products; the suction member is connected to a suction pump. By means of an additional control disk connected to the conveyor drum, the suction member is pivoted upwardly once during each rotation of the conveyor drum to the lowermost sheet of the stack and after grasping the back fold edge the suction member is pivoted back, so that the back fold edge can be grasped by the gripping member and can be pulled out from under the stack.

In another embodiment of a feeder for decollating stacked printed products known in the art, a gripping arm of the conveyor drum interacting with a drum disk is actuated by a pivotable tooth segment connected to and driven by a closed guide track arranged around the axis of rotation of the conveyor drum, wherein the toothed segment engages in a pinion to which the angle-shaped gripping arm is fastened. The partial circle radius of the toothed segment is greater by a multiple than the partial circle radius of the pinion, so that a great step-down ratio is produced which results in a large opening angle of the gripping member, so that in the open position the gripping member stands back relative to the circumference of the drum disk against which the printed products rest.

The closing force to be applied by the gripping arm and the relatively high acceleration and decelerating torques resulting from the closing and opening movements of the gripping arm, which are particularly noticeable in an embodiment with toothed segment and pinion, result in substantial wear and noise phenomena which occur especially in the area of the elements used for moving the gripping arm. When these problems are to be eliminated, additional work has to be performed which results in interruptions and increased costs.

In a similar feeder for printed sheets in accordance with CH-A-641 112, a gripping drum is arranged between two lateral drum disks of the conveyor drum. A swivel shaft is rotatably mounted on the gripping drum parallel to the axis of rotation of the conveyor drum, wherein two laterally spaced apart gripping levers are rigidly attached to the swivel shaft. A pinion is mounted between the gripping levers on the swivel shaft by means of a key. Also mounted so as to be pivotable on the swivel shaft are anvil levers which interact with the gripping levers and form together with the gripping levers a gripping device. When the anvil levers travel past a folded printed sheet edge pulled downwardly by a suction device, the gripping levers are pivoted toward the swung-out anvil lever, the printed sheet edge is grasped and the printed sheet is pulled out from under the stack. The gripping levers are actuated through the swivel shaft and the pinion by a toothed segment which is rigidly attached to a control shaft. The control shaft is rotatably mounted in the gripping drum and the two drum disks and has a cam lever which engages with a cam roller in a control groove of a stationary cam disk.

SUMMARY OF THE INVENTION

Therefore, it is the primary object of the present invention to provide a device of the above-described type which is less susceptible to wear and has a lower noise emission.

In accordance with the present invention, the movable gripping arm of the gripping device is connected to a double roller lever which is mounted on the conveyor drum so as to be pivotable about an axis extending parallel to the axis of rotation of the conveyor drum and which travels in two closed guide tracks arranged stationary in at least one vertical plane about the axis of rotation of the conveyor drum.

As a result of the configuration according to the present invention, the apparatus operates much more quietly and significantly lower wear occurs at the moving components. In addition, this solution makes it possible to use flatter curvatures at the guide tracks. The manufacture and assembly of the components of the apparatus are not complicated.

The solution according to the present invention can be utilized in a gripping device formed by a drum circumference and a movable gripping arm as well as in a gripping device formed by two gripping arms.

The various features of novelty which characterize the invention are pointed out with particularity in the claims annexed to an forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 2:
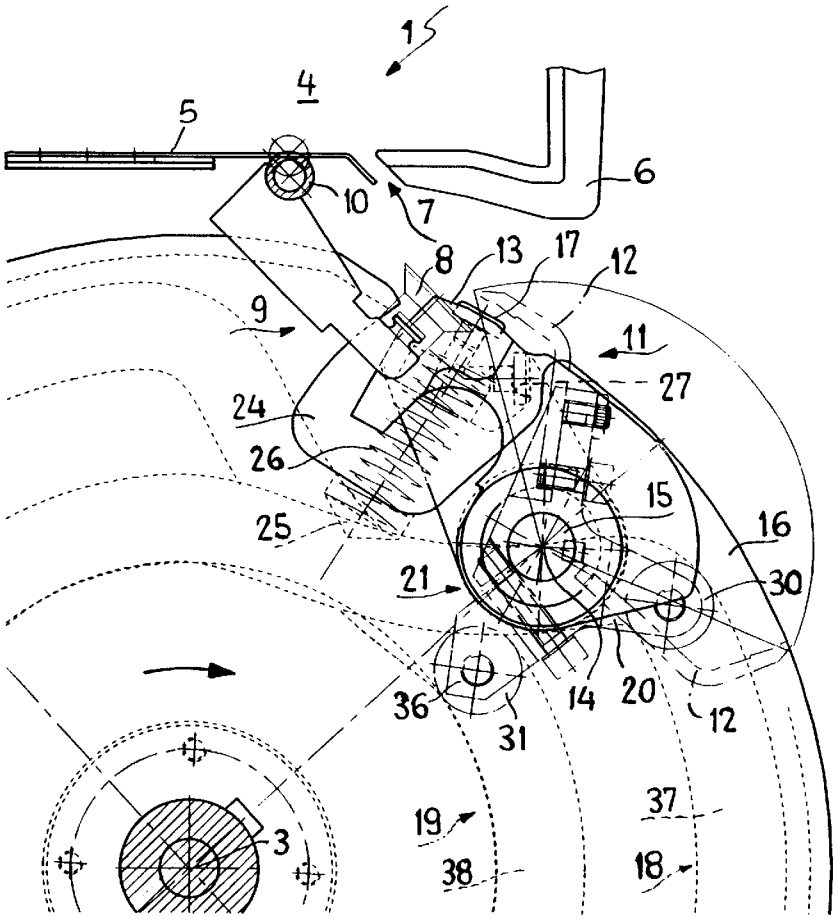
FIG. 2 is a sectional view perpendicularly of the axis of rotation of the apparatus of FIG. 1.
Figure 1:
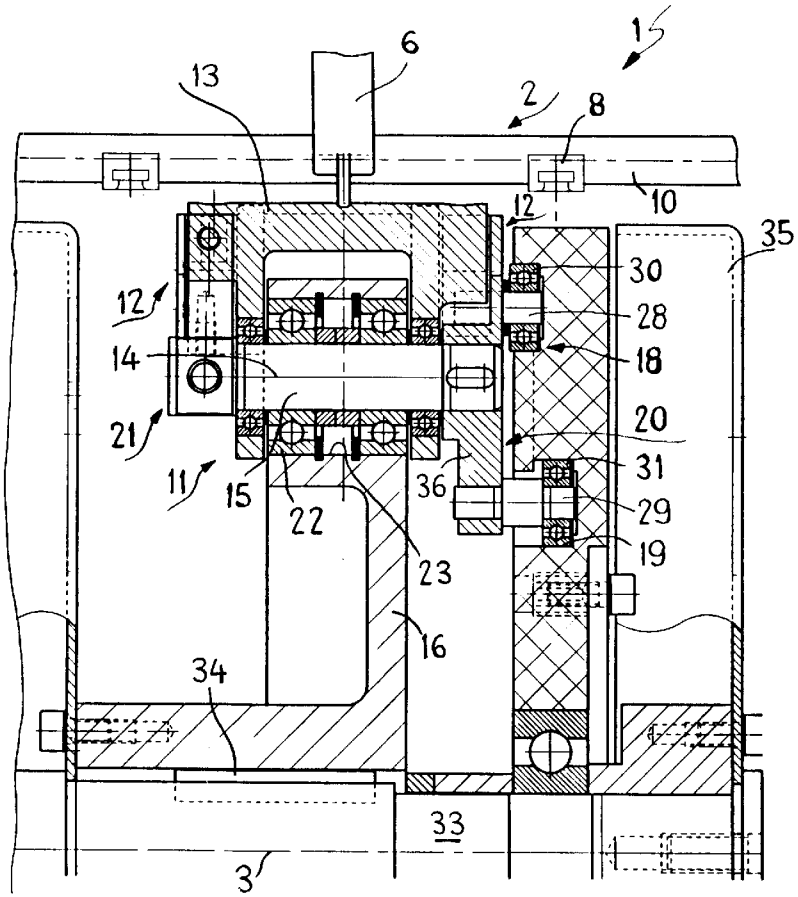
FIG. 1 is a partial section view of an apparatus according to the present invention extending in the axis of rotation of the conveyor drum of the apparatus.

FIGS. 1 and 2 of the drawing show that portion of an apparatus 1, also called feeder, for feeding products to the processing unit which is relevant with respect to the present invention as claimed.

The apparatus 1 includes a conveyor drum 2 which rotates about a horizontal axis of rotation 3. A magazine for stacking the multiple-sheet folded printed products is arranged above the conveyor drum 2. Of course, as is well known in the art, the printed products can also be supplied to the conveyor drum in a vertically stacked arrangement. The stacking table 5 of the magazine 4 supporting the printed products forms together with the pivotable retaining member 6 which is coupled to the stacking table to carry out the same cycle a bottom opening 7 through which the printed products are grasped in a timed manner at the fold area by a separating device provided with several suction member 8 and are initially partially pulled downwardly off from the stack. The individual suction members 8 are connected to a pivotably mounted hollow shaft 10 which, in turn, is connected to a vacuum source, not shown. This type of operation is known in the art and does not require further explanations.

In order to make is possible that the printed products can be partially pulled from the stack by the separating device 9, the retaining member 6 supporting the stack in the fold area is pulled back in short sequences.

Subsequently, an open gripping device 11 attached to the conveyor drum which rotates in the direction R travels underneath the printed product which has been pulled off in the fold area. The printed product is released by the separating device 9 at that moment when a movable gripping arm 12 impinges upon the fold area of the printed product or presses the printed product onto a gripping anvil 13 which interacts with the gripping device 11, as shown without printed product in FIG. 2 underneath the retaining member 6.

The gripping arm 12 shown in FIG. 1 is composed of two parts and is rigidly connected to the end portions of a shaft 15 mounted in a conveyor wheel 16 of the conveyor drum 2, wherein the shaft 15 has an axis 14 extending parallel to the axis of rotation 3. The gripping arm 12 interacts with raised portions 17 of non-metal material fastened on the gripping anvil 13, wherein the raised portions 17 advantageously influence the friction effect on the respectively grasped printed product.

The gripping device 11 is opened and closed by means of a double roller lever 20 which rotates about the axis of rotation 3 in stationary or non-rotating guide tracks 18, 19 distributed on two vertical planes. The double roller lever 20 is connected for rotation to the shaft 15 by means of a key which can be seen in the drawing and a portion of the gripping arm 12 extending at an angle in the closing direction is adjustably screwed to the double roller lever 20. The other gripping arm portion provided for the gripping device 11 is placed onto the shaft 15 and is locked to the shaft 15 by a clamping connection 21.

Between the portions extending at an angle to form the gripping arm 12, the gripping anvil 13 constructed as a lever and having a yoke-shaped cross-section rests on the shaft 15 which, in turn, is received by two spaced apart deep groove ball bearings 22 in a bore 23 in the circumferential portion of the conveyor wheel 16. As illustrated in FIG. 2, the conveyor wheel 16, which may be provided at the circumference thereof with more than only one gripping device 11, is provided in the range of operation of the gripping device 11 with a recess 24. The bottom of the recess 24 has an indentation 25 in which a compression spring 26 is arranged for pushing the gripping anvil 13 against a stop 27 at the conveyor wheel 16 as long as the gripping device does not hold a printed product.

The varying thickness of the printed products is absorbed by the compression spring 26, so that the gripping arm 12 in the closed position thereof assumes a more or less constant position.

The open position of the gripping arm 12 shown in dash-dot lines in FIG. 2, which occurs in practice approximately on the opposite side of the axis of rotation 3 of the conveyor drum 2 for releasing the printed product, is located relative to the closed position at an angle of movement $\alpha$ of about 120°. The double roller lever 20 has at the lever ends thereof rollers 30, 31 rotatably fastened on protruding bearing pins 28, 29 or deep groove ball bearings, wherein each deep groove ball bearing is arranged in one of the guide tracks 18, 19. The closed or endless guide tracks 18, 19 are located in a stationary guide shield 32 in which the drive shaft 33 of the conveyor drum 2 is also unilaterally mounted. A key 34 is provided as the drive connection between the drive shaft 33 and the conveyor drum 2. The side portions of the conveyor drum 2 are constructed as support disks 34 which serve to support the printed products which laterally protrude beyond the gripping device 11. FIG. 1 further shows that in the illustrated embodiment the guide tracks 18, 19 and the corresponding roller 22, 21 of the double roller lever 20 are arranged in planes which are offset relative to each other and extend vertically relative to the axis of rotation 3 of the conveyor drum 2.

In the illustrated embodiment, the distance of the roller axes to the axis 14 of the shaft 15 is equal, although this is not absolutely required, and the double lever 36 has the shape of an obtuse angle, as can be seen in FIG. 2, which permits in the angle portion a connection to or mounting on the shaft 15.

The guide tracks 18, 19 which act in a controlling manner on the double roller lever 20 are divided into several sections intended for triggering the operations of the gripping device 11.

It is of no significance in this connection as to whether the stack of printed products is arranged above the conveyor drum 2 with the printed products placed one on top of the other or laterally offset to the conveyor drum 2 with the printed products standing vertically next to each other; if at all, the individual operation sections of the guide tracks 18, 19, which together act on the double roller lever 20 or the gripping device 11 or the gripping arm 12, are constructed with different length.

The illustrated embodiment shows in FIG. 2 a stack of printed products placed on the stacking table 5. A rotation of the conveyor drum 2 causes the gripping device 11 to remove the lowermost printed product from the stack and feeds the printed product either for forming a stream of printed products or in a decollated formation.

By providing an opening device for the printed products arranged downstream of the apparatus according to the present invention, a use for a saddle stitcher would also be possible.

In the position of the gripping device 11 illustrated in FIG. 2, the gripping device 11 has picked up a printed product which immediately previously has been pulled by the separating device 9 in the fold area from the stack, wherein at this point in time the retaining member 6 is swung out of the grasping range of the separating device 9.

As illustrated, the gripping device 11 has just closed, i.e., the vacuum at the separating device is not switched off, and subsequently the gripping device 11 moves to transport the printed product, wherein the printed product is pulled with a relatively high speed from the stack.

The gripping or clamping force in the gripping device 11 is achieved by the constant closed position of the gripping arm 12 and the gripping anvil 13 which counteracts as a result of the compression spring 26.

When reaching approximately the opposite side of the axis of rotation 3, the gripping device 11 is once again opened and releases the printed product from conveyor drum 2. Because the stationary guide tracks 18, 19 extend concentrically with their two track portions 37 and 38 to the axis of rotation 3, the guide tacks 18, 9 hold the gripping device 11 from the grasping location until the printed product is released.

The removal of the printed products by opening the gripping device 11 takes place immediately subsequently. As a result of the fact that the guide tracks 18, 19 intersect each other following the track portions 37, 28, so that the outer guide tack 18 in the area of the track portions 37, 38 becomes now the inner track portion which is closer to the axis of rotation 3 and the inner guide track 19 in the area of the track portions 37, 38 becomes the outer track portion; of course, this transition takes place continuously or steadily. The guide tracks 18, 19 intersect each other one more time prior to the closing movement of the gripping device 11 immediately in front of the beginning of the concentrical track portions 37, 38. This sequence of operations takes place in accordance with the direction of rotation R of the conveyor drum 2.

The configuration of the guide tracks 18, 19 for keeping open the gripping device 11 by intersecting the guide tracks 18, 19, is preferably selected on the opposite side of the axis of rotation 3 in such a way that the open gripping arm 12 pivots back behind the circumference of the conveyor drum 2, essentially as illustrated in FIG. 2.

The invention is not limited by the embodiments described above which are presented as examples only but can be modified in various ways within the scope of protection defined by the appended patent claims.

I claim:

1. An apparatus for feeding printed products to a processing unit, the apparatus comprising a separating device for lifting a printed product partially from a magazine with stacked printed products, a rotating conveyor drum for individually pulling the printed product from the magazine, the rotating conveyor drum having on an approximately circular travel path a gripping device comprised of at least one movable gripping arm for receiving the printed product from the separating device, such that the printed product partially lifted from the stack by the separating device is placed with an edge thereof to be grasped against the circular travel path, wherein the gripping device is configured to be controlled between an open position and a closed position by a cam mechanism connected to a closed guide track mounted in a vertical plane relative to an axis of rotation and stationary relative to the axis of rotation, wherein the movable gripping arm of the gripping device is connected to a double roller lever having two rollers mounted on the conveyor drum so as to be pivotable about an axis extending parallel to the axis of rotation of the conveyor drum and travelling in two closed guide tracks mounted stationary in at least one vertical plane about the axis of rotation of the conveyor drum.

2. The apparatus according to claim 1, wherein the closed guide tracks provided for a roller each of the double roller lever are mounted in spaced-apart vertical planes relative to the axis of rotation of the conveyor drum.

3. The apparatus according to claim 2, wherein the rollers of the double roller lever are mounted such that one of the rollers travels in one of the guide tracks and another of the rollers travels in another of the guide tracks.

4. The apparatus according to claim 3, wherein the double roller lever is mounted between the rollers at the conveyor drum.

5. The apparatus according to claim 4, wherein the double roller lever has an angled configuration between the rollers, and wherein the double roller lever is amounted on the conveyor drum at an angled portion thereof.

6. The apparatus according to claim 5, wherein the rollers are spaced at equal distances from a pivoting axis of the double roller lever.

7. The apparatus according to claim 3, wherein the rollers are mounted so as to be offset relative to each other on the double roller lever in accordance with a distance of the guide tracks from the axis of rotation.

8. The apparatus according to claim 3, wherein each guide track has an outer first track portion corresponding to and further remote from the closed gripping device and an inner first track portion arranged concentric with the axis of rotation, wherein the track portions intersect following end portions of the first track portions for opening and closing the gripping device.

9. The apparatus according to claim 8, wherein the closed track portions corresponding to the closed gripping device form an obtuse angled circle sector about the axis of rotation of the conveyor drum.

10. The apparatus according to claim 8, wherein the guide tracks for the rollers are groove-shaped.

11. The apparatus according to claim 1, wherein the gripping device comprises a portion of the conveyor drum and the movable gripping arm.

12. The apparatus according to claim 1, wherein the gripping device is comprised of two interacting gripping arms attached to the conveyor drum.

13. The apparatus according to claim 1, wherein the gripping device comprises a gripping anvil in engagement with the movable gripping arm, wherein the gripping anvil is mounted so as to be movable against a force of a spring approximately radially of the axis of rotation of the conveyor drum.

14. The apparatus according to claim 13, wherein the gripping anvil forms a movable end of the lever mounted at the pivoting axis mounted of the gripping arm.

15. The apparatus according to claim 14, comprising a stop at the conveyor drum for defining an outer end position of the movement of the gripping anvil.

16. The apparatus according to claim 15, wherein the end position of the gripping anvil corresponds approximately to a travel path at the circumference of the conveyor drum.

17. The apparatus according to claim 1, wherein the gripping arm is angle-shaped at a free end toward the axis of rotation of the conveyor drum, and wherein the gripping arm is mounted releasably at the double roller lever or is adjustably fastened relative to the closed position of the gripping device.

* * * * *